United States Patent [19]

Debortoli et al.

[11] Patent Number: 4,826,449

[45] Date of Patent: May 2, 1989

[54] INSULATION DISPLACEMENT MEMBERS AND ELECTRICAL CONNECTORS

[75] Inventors: George Debortoli; Remo Contardo, both of Ottawa; Paul R. Despault, Kirkland, all of Canada

[73] Assignee: Northern Telecom Limited, Montreal, Canada

[21] Appl. No.: 157,021

[22] Filed: Feb. 18, 1988

[30] Foreign Application Priority Data

Nov. 6, 1987 [CA] Canada ..... 551278

[51] Int. Cl.[4] ..... H01R 4/24

[52] U.S. Cl. ..... 439/411; 439/417; 439/711; 439/727

[58] Field of Search ..... 439/389–414, 439/417, 418, 419, 431, 432, 433, 436–441, 443, 711, 727

[56] References Cited

U.S. PATENT DOCUMENTS

| | | | |
|---|---|---|---|
| 3,636,500 | 1/1972 | Sedlacek | 439/395 |
| 4,118,096 | 10/1978 | Takahashi | 439/400 |
| 4,527,852 | 7/1985 | Dechelette | 439/396 |
| 4,548,459 | 10/1985 | Mosser, III | 439/395 |
| 4,652,071 | 3/1987 | De Bortoli et al. | 439/396 |
| 4,682,835 | 7/1987 | Aujla et al. | 439/395 |

*Primary Examiner*—David Pirlot

*Attorney, Agent, or Firm*—R. J. Austin

[57] ABSTRACT

Insulation displacement terminal member having cantilever spring contact members which are spaced-apart to receive a conductor between them. Each contact member has an outward projection for engagement with the wall of a cavity of a connector housing to prevent undue movement apart of the members when a heavily insulated conductor is forced between them under extremely cold conditions. Ideally, the projections are convex to permit a rolling action upon the cavity wall.

6 Claims, 3 Drawing Sheets

INSULATION DISPLACEMENT MEMBERS AND ELECTRICAL CONNECTORS

This invention relates to insulation displacement members and electrical connectors.

Many designs of electrical connectors are known. In some electrical connectors, insulation displacement terminals are used. Insulation displacement terminals of various constructions are well known. In use of such terminals, an insulated conductor is forced down between two cantilever spring contact members. This movement displaces insulation from around the conductor so that the conductor comes into electrical contact with each of the contact members. It is conventional to provide cutting edges on the contact members for the purpose of cutting into the insulation. However, it is not unknown for the cutting edges to cut through the insulation and into the conductor itself leading to eventual conductor breakage. U.S. Pat. Nos. 3,521,221 issued July 21, 1970 and 4,002,391 issued Jan. 11, 1972 describe examples of such terminals. With other terminal constructions, a crushing effect upon the insulation is relied upon to produce contact with the conductor itself. However, such terminals may be unsatisfactory because insulation instead of being displaced may become trapped between the terminal and the conductor thereby reducing or eliminating the conductive path.

It is desirable for conductors to be inserted, removed and replaced many times within insulation displacement terminals. Hence, the terminals should not be stressed unduly while providing a required minimum contact force between the terminal and the conductor to produce a satisfactory and continuous electrical connection. These requirements have, on the whole, only been produced by insulation displacement terminals which would accept one conductor size only.

An insulation displacement terminal member and having an insulation displacement terminal as described in U.S. Pat. No. 4,682,835 granted July 28, 1987 in the name of S. Aujla, et al overcomes the above problems. This particular insulation displacement terminal member is designed to produce a greater elastic compliance between the contact members of the terminal and to provide more uniformly distributed stresses to enable the terminal to be used with a wide range of conductors, e.g. between the sizes of 26 AWG and 18 AWG. In addition, this particular insulation displacement terminal may be used many times by insertion, removal and reinsertion of conductors. Also, replacement conductors may be of different gauges without detracting from the electrical performance of the terminal. It has been found however that while the terminal member described in U.S. Pat. No. 4,682,835 performs satisfactorily over a wide range of temperatures for the various sizes of conductors, certain problems may exist when connecting larger diameter conductors having thick insulation into the terminal at particularly low temperatures. It has been found in some instances that these low temperatures produce a hardening of the insulation material such that the cutting edges of contact members of the terminal may not cut entirely through the insulation thereby producing an unsatisfactory electrical path between the terminal and the conductor.

Furthermore, terminal members as described in U.S. Pat. No. 4,682,835 are useful in electrical connector constructions which have minimal outside dimension requirements to enable such connectors to be assembled together with high density in certain situations. An example of such an electrical connector is as described in British patent application No. 2,172,650A published Oct. 15, 1986 in the name of G. Debortoli, et al and in the corresponding U.S. Pat. No. 4,652,071 granted Mar. 24, 1987. As may be seen from these two latter documents, connectors are used for connecting drop wires to a customer's premises from a distribution cable and are closely located together to enable them to be mounted within a suitable housing carried, for instance, upon a mounting pole or carried by a cable supporting strand. When terminal members described in U.S. Pat. No. 4,682,835 are used in such connectors, then clearly there is little clearance between the terminals and inside surfaces of the connector housing. Hence, if the cantilever members of the terminal are forced apart further than desired by uncut hardened insulation on a conductor, the contact members may interfere with the closing of the connector during downward movement of a closure member onto a connector body whereby complete closure of the connector may be impossible. Damage may also result to the contact members or the connector body and total lack of contact with the conductor itself.

The present invention seeks to provide an insulation displacement terminal member which will overcome the above problems when incorporated into a connector. The present invention also provides an electrical connector incorporating such an insulation displacement terminal member.

Accordingly, the present invention provides an insulation displacement terminal member having a base and an insulation displacement terminal comprising two cantilever spring contact members extending upwards from the base and in which the contact members are spaced apart to define a conductor receiving slot between them. According to the invention, each contact member has a lower portion extending from the base, and an upper portion, a protrusion extending inwardly from one contact member to the other to pre-stress them in the direction of their separation, and an outward projection is provided on the outer edge of each contact member at a position spaced from the base. Outer edges of the contact members extend upwardly and inwardly along the lower portions and upwardly and outwardly along the upper portions such that, in use, these contact members are spaced away from the walls of a cavity containing the terminal in an electrical connector. Hence, the outward projections on the outer edges act as fulcrums which contact the walls of the cavity during movement apart of the upper portions of the contact members. The pressing action of the outward projections upon these walls serves to stiffen each contact member along its upper portions even though bending may still take place from the base along each contact member. Thus, the stiffness of each contact member is increased thereby increasing the force applied to insulation surrounding a conductor as the conductor is forced between the upper portions of the contact members. As a result, the projections resist any tendency for the upper portions of the contact members to separate widely when a conductor carrying hard insulation is passed between them, thereby minimizing the chances of the contact members from abutting the closure member and preventing its movement.

In a preferred arrangement, the projections are of convex curvature so that they may produce a rolling action upon the wall of the cavity of the body of the connector and also, preferably, the projections should be disposed between the upwardly inclined outer edges of the lower portions and the upwardly and outwardly inclined outer edges of the upper portions of the contact members.

One embodiment of the invention will now be described by way of example, with reference to the accompanying drawings, in which.

Figure 1:
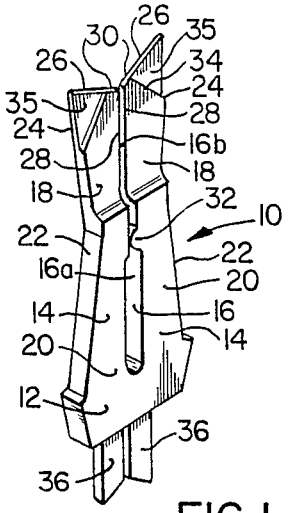
FIG. 1 PRIOR ART
FIG. 1 is an isometric view of a prior insulation displacement terminal.

As shown in FIG. 1, an insulation displacement terminal member 10 according to the prior art is of the construction described in U.S. Pat. No. 4,682,835 granted July 28, 1987 to S. Aujla, et al. The terminal member 10 comprises a base 12 from which a terminal comprising two cantilever spring contact members 14 extend upwardly. The terminal member is formed from flat strip conductor material with the contact members 14 extending widthwise in a common plane away from a slot 16 formed between them. Each contact member has upper and lower portions 18 and 20, respectively. Between the lower portions 20, the slot 16 is wider at a lower slot portion **16*a* than at an upper slot portion 16*b* which lies between the upper portions 18** of the contact members.

Outer edges 22 of the lower portions of the contact members extend upwardly from the base while extending inwardly of the terminal so as to progressively decrease the width of the lower portions as shown. Conversely, the outer edges 24 of the upper portions 28 of the contact members extend upwardly from the edges 22 while being inclined outwardly of the terminal so as effectively to produce a slight widening of the upper portions towards their upper ends. Upper edges 26 of the contact members are inclined downwardly towards the slot 16 and meet inner edges 28 of the contact members to produce cutting edges 30 one at each side of the opening to the slot 16. One of the contact members is provided with an inwardly extending protrusion 32 which is disposed above the wider part **16*a* of the slot. This protrusion engages the opposite inner edge 28** of the other contact member and is formed so as to apply pressure against that edge in the opening direction of the contact members so as to pre-stress them. This is to ensure that the contact members will apply a sufficient gripping load upon a conductor of small diameter, e.g. 26 gauge, when such a conductor is placed between them. Preferably, this protrusion is formed by swaging as described in U.S. Pat. No. 4,682,835 mentioned above.

Also as described in U.S. Pat. No. 4,682,835, the upper portions of the contact members are thinner than the lower portions. This is to reduce the load necessary to force a conductor between the contact members while ensuring that the lower parts of the terminal are of sufficient cross-sectional area to produce the required resilient bending characteristics to enable it to be used with conductors over a wide range of gauges, e.g. between 18 and 26 AWG. In fact, the upper portions are reduced in thickness in two stages. A first reduction in thickness occurs slightly above the protrusion 32, as can be seen from FIG. 1, and a further reduction in thickness occurs above an inclined edge 34, this further reduction extending over a substantially triangular region 35 to the upper edge 26 of each upper portion. As described in U.S. Pat. No. 4,682,835 referred to above, the reduced thickness above the edge 34 provides a better cutting action during initial insertion of a drop wire particularly one of heavy gauge such as 18 AWG.

The terminal members 10 also have relatively short cantilever spring contact members 36 of a lower insulation displacement terminal extending downwardly from the base 12.

Figure 2:
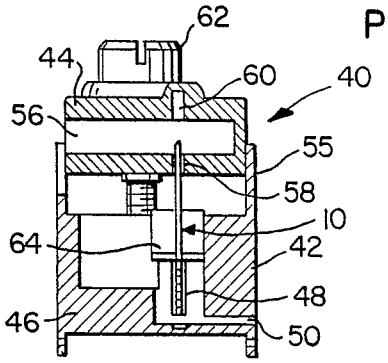
FIG. 2 PRIOR ART
FIG. 2 is a cross-sectional view through a prior connector with a closure member in a retracted position.
Figure 3:
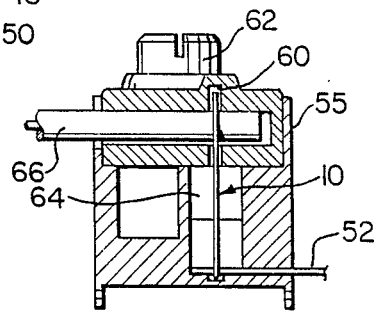
FIG. 3 PRIOR ART
FIG. 3 is a view similar to FIG. 2 with the closure member in an operative position with two conductors connected.
Figure 4:
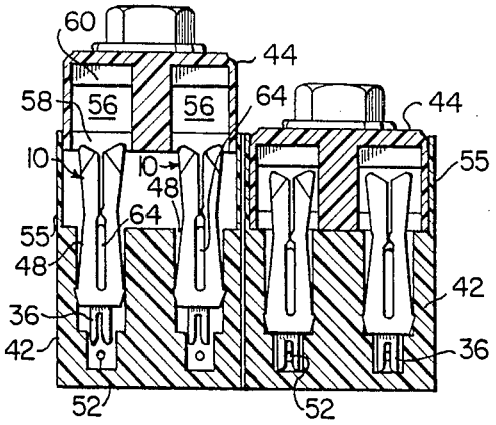
FIG. 4 PRIOR ART
FIG. 4 is on a larger scale and is a cross-sectional view along line IV—IV in FIG. 2 through two side-by-side prior connectors each incorporating two terminals shown in FIG. 1, the left-hand and right-hand sides representing two different stages in connecting a connector to insulated conductors.

While it has been found that the prior terminal member shown in FIG. 1 is particularly effective in making good electrical contact with drop wires between 26 and 18 gauge, problems have occasionally been found when these terminal members have been used within electrical connectors of minimal outside dimensions and in particularly cold environments, e.g. about −40° C. Such problems may be found when the terminal member is used as part of an electrical connector of the construction described in U.S. Pat. No. 4,652,071 and in its corresponding British Application No. 2,173,650A. In this particular connector 40, as shown in FIGS. 2 and 3, a housing comprises an insulating body 42 and a closure member 44. The insulating body 42 has a base 46 with two cavities 48 for accommodating spaced-apart terminal members 10 (see FIG. 4). Towards the bottom of the base 46 are disposed two inlet passages 50 for insulated conductors 52 of a distribution cable (not shown).

The terminal members are disposed in the cavities 48 with their upper portions 18 extending upwardly beyond the base and lying between surrounding walls 55 of the body.

The closure 44 is provided with two spaced-apart passages 56 for acceptance of insulated drop wires into wire terminal positions within the closure member. In addition the closure member is provided with an entry passage 58 and a exit passage 60 which are aligned across the passage 56 and are aligned with the upper portions of the terminal members 10.

The closure member 44 is movable between a retracted and upper position, shown in FIG. 2, and a lower fully retained or operative position, shown in FIG. 3, by rotation of a screw 62. This screw is held rotatably captive by the closure member and received in a screw-threaded hole passing through the base of the body.

In use of the prior connector and terminal member, the conductors 52 may be connected to the lower contact members 36 of the terminals before inserting the drop wires. This is performed by moving the closure member downwards as described in the previous patents so that it engages means for uging the contact members downwardly from a detent or retracted position (shown in FIG. 2 and the left-hand side of FIGS. 4 and 5) and into its operative position (shown in FIG. 3 and the right-hand side of FIGS. 4 and 5). The urging means may be in the form of a block 64 inserted into the wider parts 16*a* of the slots. The underside of the closure member engages these blocks 64 and forces the terminal members 10 downwardly so that the conductors 52 become engaged between the lower contact members 36 while their insulation is stripped away to provide electrical contact with the terminal members 10. The closure member is then raised to enable the drop wires 66 to be inserted into the passages 56 and across the tops of the terminal members 10 substantially in alignment with the slots 16. This is shown at the left-hand side of FIG. 5. The closure member is again moved downwards to its retained position with the intention of forcing the drop wires down between the upper portions of the terminal members so as to cut through the insulation on the cutting edges 30 and to force the conductors into the upper portions 16*b* of the slots.

On the whole, the above operation is successful, but as will now be described, problems do arise at low temperatures with 18 AWG heavily insulated drop wire.

Figure 5:
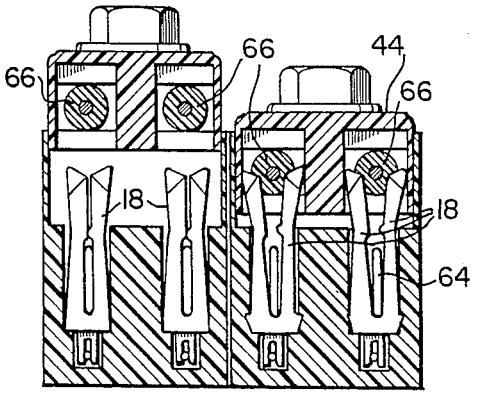
FIG. 5 PRIOR ART
FIG. 5 is a view similar to FIG. 4 and showing two further stages in connecting the prior connector to the conductors.

As shown on the left-hand side of FIG. 5, the closure member 44 is in its upper retracted position with two heavily insulated 18 gauge drop wires 66 disposed in position in the passages 56 ready for connection to the terminal members 10. As shown on the right-hand side of FIG. 5, during the descent of the closure member 44 in exceptionally cold weather conditions, the insulation may be sufficiently stiff and hard to resist cutting action by the cutting edges 30 of the terminal members whereby the cutting edges only pass partially through the insulation. Apart from an unsatisfactory or total lack of electrical contact being provided with a drop wire, such an occurrence may result in the forcing of the upper portions of the terminal members sufficiently apart that one or more of the upper portions moves outwardly and engages and then jams against the vertical walls of its passage 56 so as to damage the contact members 14 and/or restrict further downward movement of the closure member. The right-hand side of FIG. 5 shows such a situation with the upper portions of the members 10, one embedded into the walls of the passages 56. Such a large degree of movement is because the outward resilient bending of the contact members about their base and unrestricted by the walls of the cavity 48, because the inclined outer edges of the lower portions move away from these walls.

Figure 6:
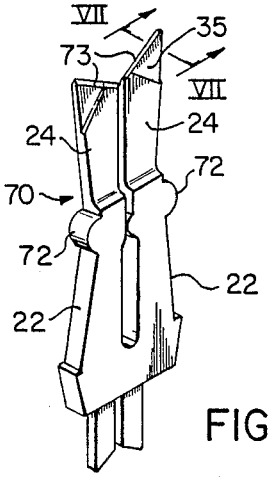
FIG. 6 is a view similar to FIG. 1 of an insulation displacement terminal according to the embodiment.

The present invention provides a terminal member which is designed to minimize the above problem. As shown in FIG. 6, a terminal member 70 according to an embodiment of the invention is basically of the same structure as the terminal member 10 described above. The same reference numerals will be used for identical parts. The terminal member 70 differs basically from the prior terminal member however in that it has two outward projections 72 extending one from the outer edge of each contact member at a position spaced from the base. These projections may be located at any position spaced from the base to provide additional stiffness to the contact members and further resist their outward movement, as will be described. However, it is preferred, and as shown in the embodiment, for the projections to be disposed between the upwardly and inwardly inclined outer edges 22 of the lower portions and the upwardly and outwardly inclined outer edges 24 of the upper portions of the contact members. Also as shown, it is preferable for each projection to have a surface of convex curvature.

Figure 7:
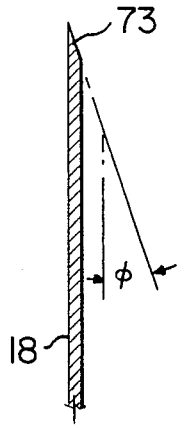
FIG. 7 is a cross-sectional view taken along line VII—VII in FIG. 6 and to a larger scale.

In addition, in the embodiment, but not essential to the present invention, the upper edge 26 of each contact member is formed as a cutting edge 73 along the reduced thickness region 35. The cutting edge is preferably formed with an included angle 0—between 26° to 30° as shown by FIG. 7.

Figure 8:
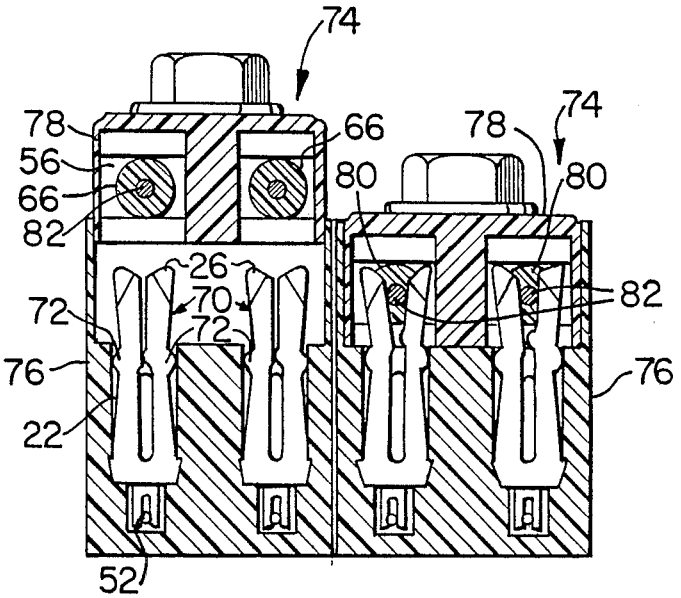
FIG. 8 is a view similar to FIG. 4 through an electrical connector of the embodiment showing two stages in connecting the connector to two conductors.

In use, two terminal members 70 form part of an electrical connector 74 shown in FIG. 8. The connector 74 has an insulating body 76 and a closure member 78 of the same construction described with reference to FIGS. 2 to 5. In respect of the parts of the body 76 and closure member 78, the same reference numerals will be used as in FIGS. 2 to 5.

As can be seen from FIG. 8, when the terminal members are in their lower or operative positions in the body 76 and have made electrical contact with the conductors 52, the closure member 78 is returned to its raised position as shown at the left-hand side of FIG. 8.

In this position, the outer edges 22 of the lower portions of the contact members are spaced apart from the walls of the cavities 48. The outward projections 72 however extend towards these walls and may be spaced slightly from them. With the heavily insulated 18 AWG drop wires 66 inserted into the passages 56 of the closure member as shown on the left-hand side of FIG. 8, the closure member is moved downwardly towards its fully retained position shown on the right-hand side of FIG. 8. During this downward movement, the drop wires are moved into contact with the upper surfaces 26 of the contact members and the closure member forces the drop wires downwardly so that the cutting edges 30 pass through the insulation 80 of the conductors. The cutting action is assisted by the cutting edges 35 which cut through the outer regions of insulation. As the conductors move downwardly, the wires move between the upper portions of the contact members to effect their spreading apart and to accommodate the 18 gauge wires 82 between them. During this movement the projections 72 engage the walls of the cavities 48 so as to stiffen the contact members and increase their resistance to outward deformation. As a result, even if the drop wires are inserted at extremely low temperatures, e.g. around −40° C., then the resistance to outward movement provided by the engagement of the projections with the cavity walls, effectively causes the cutting edges 30 to pass through the insulation 80 of the conductors. Hence, opening of the contact members is not excessive, the insulation is completely removed from around the conductor wires in alignment with the cutting edges 30 and the bared portions of conductor wires pass into the upper parts 16*b* of the slots to enable good electrical contact to be made with the contact members 14. Poor or lack of contact of the contact members with the conductor is also avoided. The contact members are thus not allowed to move outwardly against the walls of passages 56 so that the upper portions cannot interfere with the closure member and cannot prevent its movement into its fully retained or operative position. During the outward movement of the contact members, the projections 72 roll on their convex surfaces upon the walls of the cavities 48, the projections acting as fulcrums while still enabling the contact members to flex along their whole length, but in a slightly different manner from that in situations where the projections 72 are not incorporated as in the prior terminal members discussed above. The projections 72 do not act as anchorages to shorten the length of the contact members but still enable the contact members to flex from the base.

If the projections 72 have clearance from the side walls of the cavities 48, then the contact members may operate in their more conventional fashion when inserting other drop wires of smaller gauges between the contact members.

What is claimed is:

1. An electrical connector having an insulating body, a closure member and an insulation displacement terminal member in which:

the insulation displacement terminal member comprises:

a base;

an insulation displacement terminal comprising two cantilever spring contact members extending upwardly from the base and having spaced-apart and opposing inner edges to define a conductor receiving slot between the contact members, the slot being open at the top to receive a conductor;

each contact member having a lower portion extending from the base and an upper portion, the two upper portions having upwardly and outwardly inclined outer edges and upper insulation cutting edges which extend from the outer edges to meet the inner edges; and an outward projection on the outer edge of each contact member at a position between the upper and lower portions of the respective contact member;

the insulation displacement terminal member locatable in an operative position with the lower portions of the contact members within a cavity defined within the insulating body with the outer edges of the lower portions spaced from the walls of the cavity and with the outward projections extending towards said walls; and the closure member has:

(a) a guidance passage for guidance of an insulated conductor wire into a wire terminal position within the closure member; and (b) entry and exit passages for the upper portions of the contact members, the entry and exit passages aligned across the guidance passage;

the closure member being movable to cause the upper portions of the contact members to pass through the entry and exit passages and across the guidance passage, and upon engagement of conductor insulation with the insulation cutting edges of the contact members, the outward projections act as fulcrums on the cavity walls of the body during movement apart of the upper portions of the contact members so as to resist engagement of said upper portions with walls of the passages of the closure member.

2. An electrical conductor according to claim 1 wherein each projection has a surface of convex curvature.

3. An electrical connector according to claim 1 wherein the insulation displacement terminal has two other cantilever spring contact members extending downwardly from the base and the body has a passage for entry of a conductor to be electrically connected between said two other contact members.

4. An electrical connector according to claim 1 wherein a protrusion extends from one inner edge to engage the other inner edge of the contact members in a position spaced from both the bottom and top of the slot to pre-stress the contact members in a direction of separation of the members.

5. An electrial connector according to claim 4 wherein the slot between the contact members is wider between the lower portions of the contact members than between the upper portions and the protrusion is disposed above the wider part of the slot.

6. An electrical connector according to claim 5 wherein the upper portions of the contact members are thinner than the lower portions downwardly from the upper edges.

* * * * *